US009487908B1

(12) United States Patent
Roch

(10) Patent No.: US 9,487,908 B1
(45) Date of Patent: Nov. 8, 2016

(54) TOP ACCESS CLOTHES DRYER WITH MOTOR-GENERATOR AND CATCH PAN

(71) Applicant: Adam Roch, Chadds Ford, PA (US)

(72) Inventor: Adam Roch, Chadds Ford, PA (US)

( * ) Notice: Subject to any disclaimer, the term of this patent is extended or adjusted under 35 U.S.C. 154(b) by 63 days.

(21) Appl. No.: 14/699,925

(22) Filed: Apr. 29, 2015

(51) Int. Cl.
*D06F 58/12* (2006.01)
*D06F 49/00* (2006.01)

(52) U.S. Cl.
CPC ..... *D06F 49/003* (2013.01)

(58) Field of Classification Search
CPC ..... D06F 58/00; D06F 58/12; D06F 58/20; F26B 19/00; F26B 21/00; F26B 21/06
USPC ..... 34/595, 601, 606, 610; 68/5 C, 5 R, 68/12.16, 19, 20; 8/139, 149, 159
See application file for complete search history.

(56) References Cited

U.S. PATENT DOCUMENTS 2,985,967 A * 5/1961 Pataillot ..... D06F 58/02 34/608
4,412,390 A * 11/1983 Grant ..... D06F 49/003 188/166
4,535,610 A * 8/1985 Fey ..... D06F 29/00 248/550
6,363,756 B1 4/2002 Seagar et al.
6,748,618 B1 6/2004 Darby et al.
7,020,985 B2 * 4/2006 Casey ..... D06F 58/206 34/595
7,536,807 B2 5/2009 Baier
7,627,960 B2 * 12/2009 Beyerle ..... D06F 29/00 211/85.3
7,913,419 B2 * 3/2011 Tomasi ..... D06F 29/00 211/85.3
8,261,466 B2 * 9/2012 Latack ..... D06F 58/04 34/601
8,590,083 B2 * 11/2013 Rhodes ..... D06F 33/02 68/12.02
9,057,153 B2 * 6/2015 Yu ..... D06F 58/10
9,121,128 B2 * 9/2015 Hong ..... D06F 58/02
9,169,589 B1 * 10/2015 Sales ..... D06F 25/00
9,381,390 B1 * 7/2016 Roch ..... D06F 95/00
2016/0045841 A1 * 2/2016 Kaplan ..... B01J 19/0093 429/49

FOREIGN PATENT DOCUMENTS

BE EP 2682513 A1 * 1/2014 ..... D06F 58/22
BE WO 2014005887 A1 * 1/2014 ..... D06F 58/22

* cited by examiner

*Primary Examiner* — Stephen M Gravini
(74) *Attorney, Agent, or Firm* — Crossley & Stevenson Intellectual Property Law

(57) ABSTRACT

A top access clothes dryer with motor-generator and catch pan has a case that combines a pair of doors within a top side with a pair of drum doors in a revolving drum within to allow a generous access to the drum. A pair of spaced apart storage compartments is disposed within the top side and is accessible upon an opening of the case doors. A motor-generator is in a drive wheel contact with the drum and is used to power the drum and to harvest kinetic energy from the drum. A catch pan with switched pump is removably fitted below the case and provides removal of accidentally spilled water from the case.

4 Claims, 5 Drawing Sheets

TOP ACCESS CLOTHES DRYER WITH MOTOR-GENERATOR AND CATCH PAN

BACKGROUND OF THE INVENTION

Washers and dryers are frequently used appliances in most homes. Quite often, such appliances are confined within limited spaces. Yet a plurality of accessories is used with washers and dryers. Accessories such as treatments, detergents, and anti-static items are well understood examples. With typically cylindrical drums, much space within a washer and a dryer case is wasted. Another concern regarding such appliances is an energy waste regarding significant inertial forces generated by a rotation of wet items within these appliances. Typically, some form of a braking is used to slow and stop the appliances and the inertial forces are wasted. Another issue in laundry areas containing such named appliances is water overflow. A host of floor and floor coverings have been damaged and ruined by appliance water overflow. Still another concern for many is a need for top access to avoid a person having to bend to load and retrieve clothes. The present top access clothes dryer with motor-generator and catch pan provides solutions to these needs, issues and concerns with the ergonomically friendly top access, with storage readily available within the top access, with an ability to harvest formerly wasted energy, and with a pumped catch pan that is selectively sized to include a space for an additional appliance.

FIELD OF THE INVENTION

The present top access clothes dryer with motor-generator and catch pan relates to clothes dryers.

SUMMARY OF THE INVENTION

The general purpose of the top access clothes dryer with motor-generator and catch pan, described subsequently in greater detail, is to provide a top access clothes dryer with motor-generator and catch pan that has many novel features that result in a top access clothes dryer with motor-generator and catch pan which is not anticipated, rendered obvious, suggested, or even implied by prior art, either alone or in combination thereof.

To accomplish this, the top access clothes dryer with motor-generator and catch pan has a case having a front side and a back side spaced apart from the front side, a left side and a right side spaced apart from the left side, a top side and a bottom side spaced apart from the top side. A transparent panel is disposed in the front side adjacent the bottom side. The transparent panel affords visual inspection of any liquid leaks and of the motor-generator. A first door and a second door disposed selectively adjacent the first door are disposed in the top side. Each door opens upwardly from an approximate center of the top side with regard to the front side and the back side. The first door hingedly opens upwardly to a position above the left side. The second door hingedly opens upwardly to a position above the right side.

A walled pan having an upwardly facing opening is selectively provided. The walled pan is disposed beneath and selectively unfastened to the bottom side. A quartet of legs is disposed below the bottom side. At least one of the legs is hollow. A switched pump is disposed within one hollow leg. The switched pump is in an on condition only when sensing a water level within the hollow leg. An alarm sounds upon an automatic initiation of the switched pump. Such switched pumps are well known in the arts of water and other liquid evacuation. A filter is disposed within the walled pan. The filter is in operational communication with the switched pump wherein any debris within the pan does not interfere with the switched pump. A drain line is disposed below the walled pan. The drain line is in operational communication with the switched pump. The walled pan is selectively sized to hold the case and an existing additional clothes handling appliance such as a washer, wherein an advantage against a water loss within an area or a room is enjoyed.

A constant diameter drum is rotatably disposed within the case. The drum has an in interior and an exterior spaced apart from the interior. The drum rotates about a first bearing disposed within the front side and a second bearing disposed within the back side. A hinged first drum door having a first leading edge and a second drum door having a second leading edge selectively disposed adjacent the first leading edge are provided within the drum. The drum doors provide access from the exterior to the interior. The first leading edge and the second leading edge selectively open outwardly from the drum when in an open position. The first leading edge and the second leading edge selectively abut to seal the drum doors, and the drum.

A pentagonal first storage compartment having a first opening is selectively sealed beneath the first door. The first opening is continuously disposed from proximal the front side to proximal the back side. The first storage compartment is disposed adjacent the left side and the top side. A pentagonal second storage compartment having a second opening is selectively sealed beneath the second door. The second opening is continuously disposed from proximal the front side to proximal the back side. The second storage compartment is disposed adjacent the right side and the top side.

A motor-generator is disposed within the case proximal the right side and the bottom side. The motor-generator has a centrally disposed axle having a first end and a second end spaced apart from the first end. The motor-generator has an electrical inlet and an electrical outlet. The switched pump is in electrical operational communication with the electrical inlet. A drive wheel is disposed on the first end. The drive wheel is in frictional operational communication with the exterior. A blower wheel is disposed on the second end. The blower wheel is in operational communication with the interior, a practice extremely well known in the art of clothes dryers. The motor-generator imparts a rotational kinetic energy to the drum in a first condition of functioning as a motor. The motor-generator absorbs and converts a rotational kinetic energy from the drum in a second condition of functioning as a generator. Generated electricity from the motor-generator is transferred to the electrical outlet and thereupon employed by a user as chosen.

Examples of a use of generated electricity might be to store the electricity in a battery or to convert and sell the electricity to an electrical power organization.

A control panel is disposed on the top side adjacent the back side. The control panel includes a plurality of controls in operational communication with the motor-generator. A vent is disposed within the control panel. The vent is in operational communication with the interior.

Thus has been broadly outlined the more important features of the present top access clothes dryer with motor-generator and catch pan so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
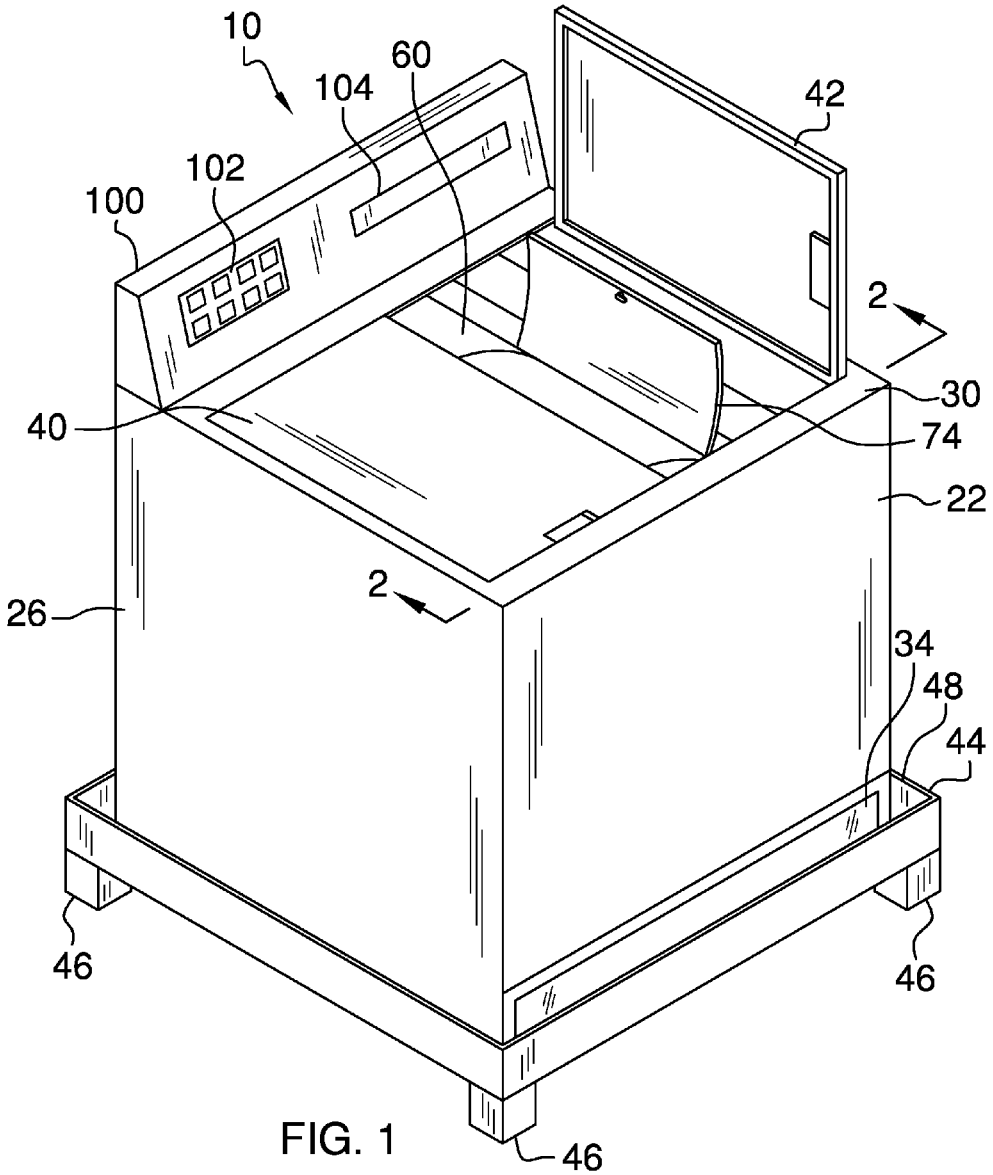
FIG. 1 is a perspective view.
Figure 2:
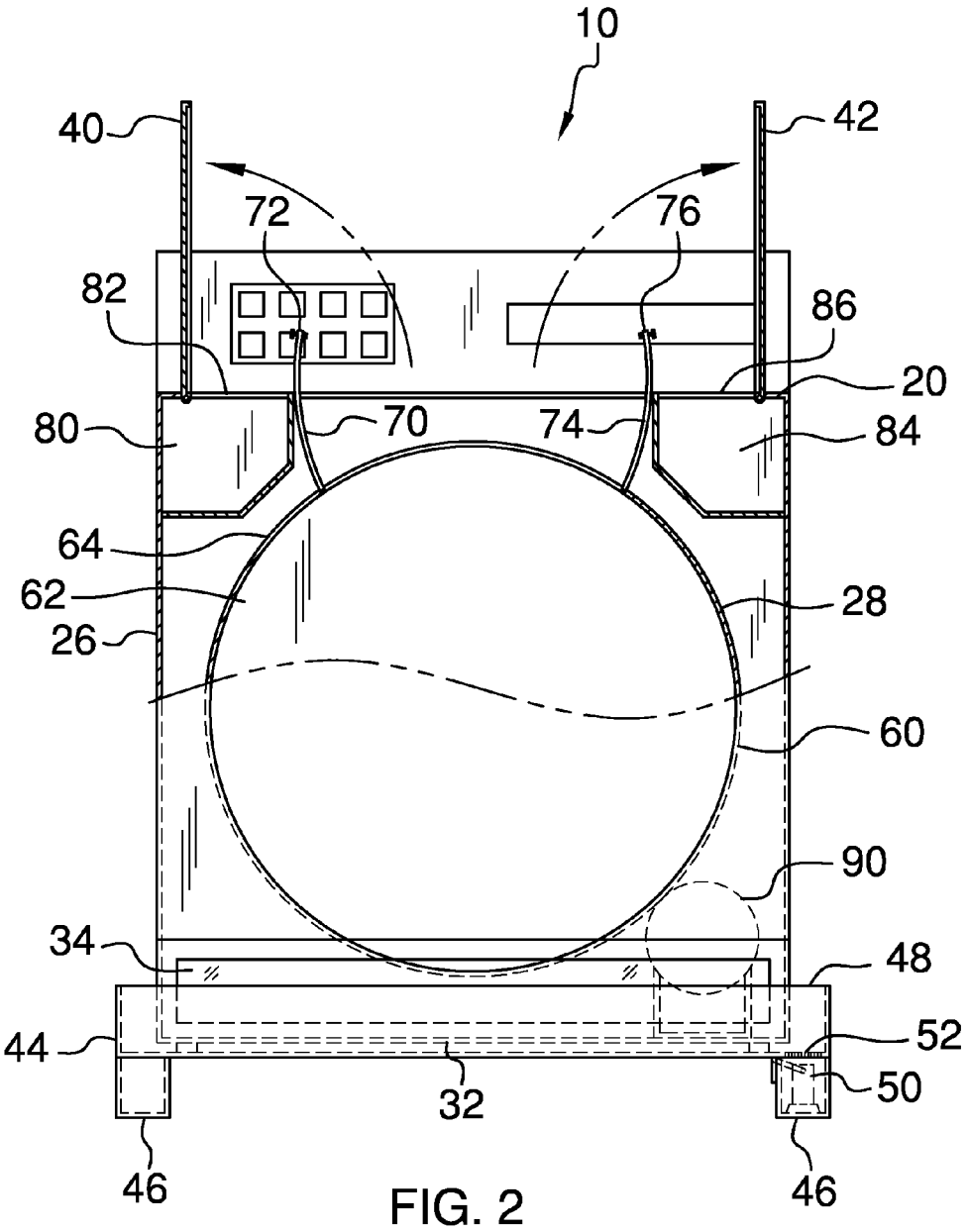
FIG. 2 is a cross sectional view of FIG. 1 taken along line 2-2.
Figure 3:
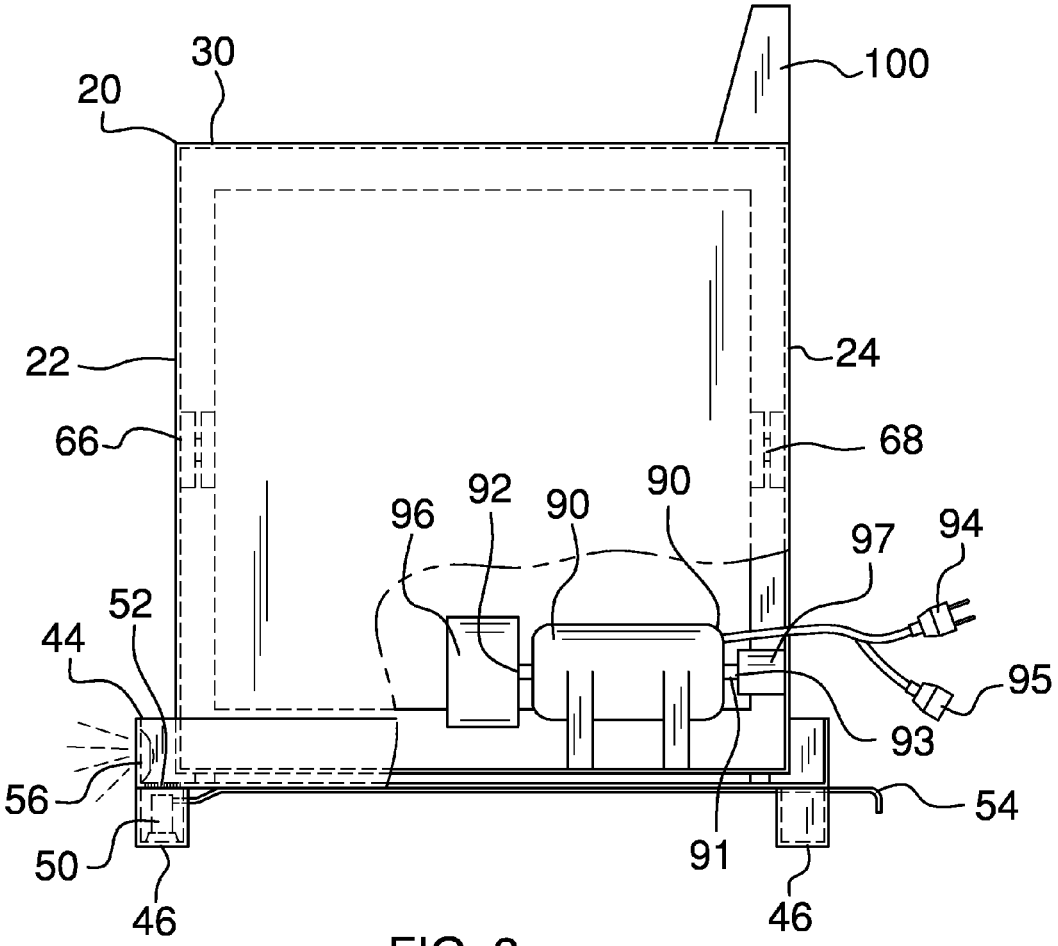
FIG. 3 is a partial cutaway view of a right side.
Figure 4:
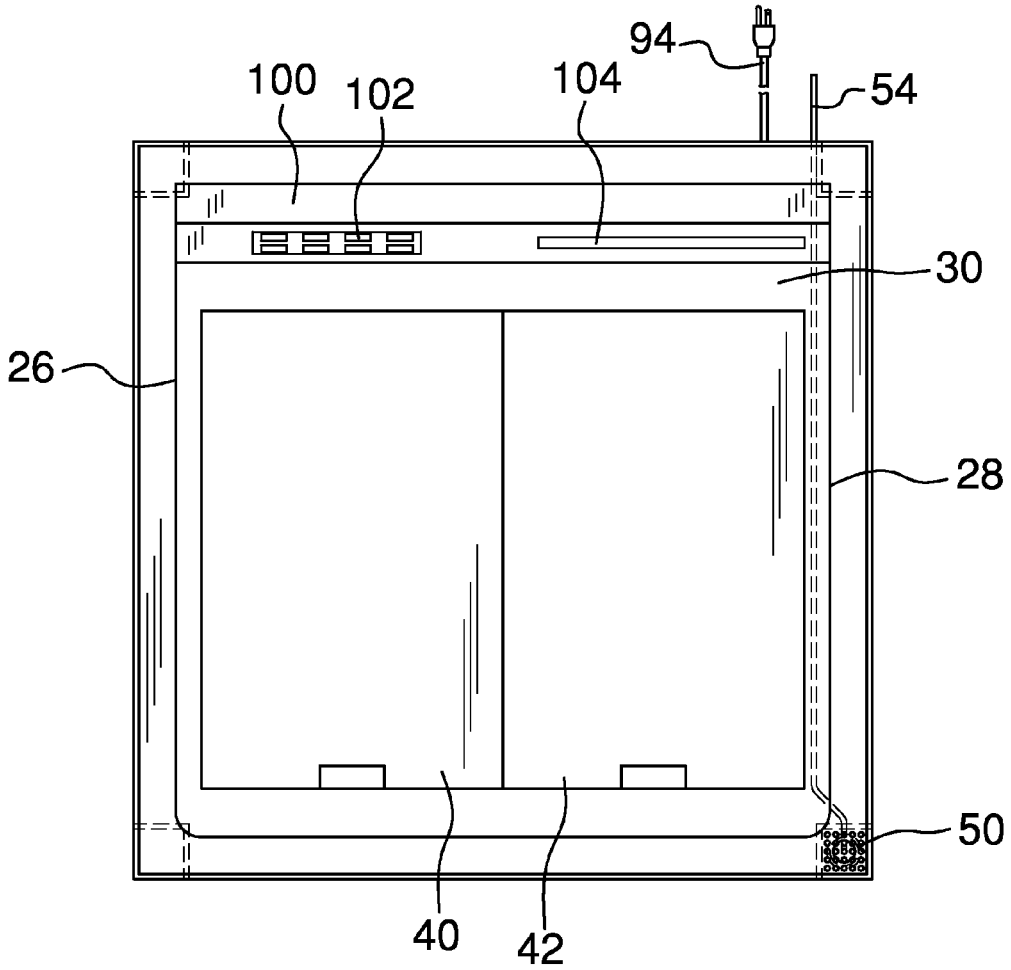
FIG. 4 is a top plan view.
Figure 5:
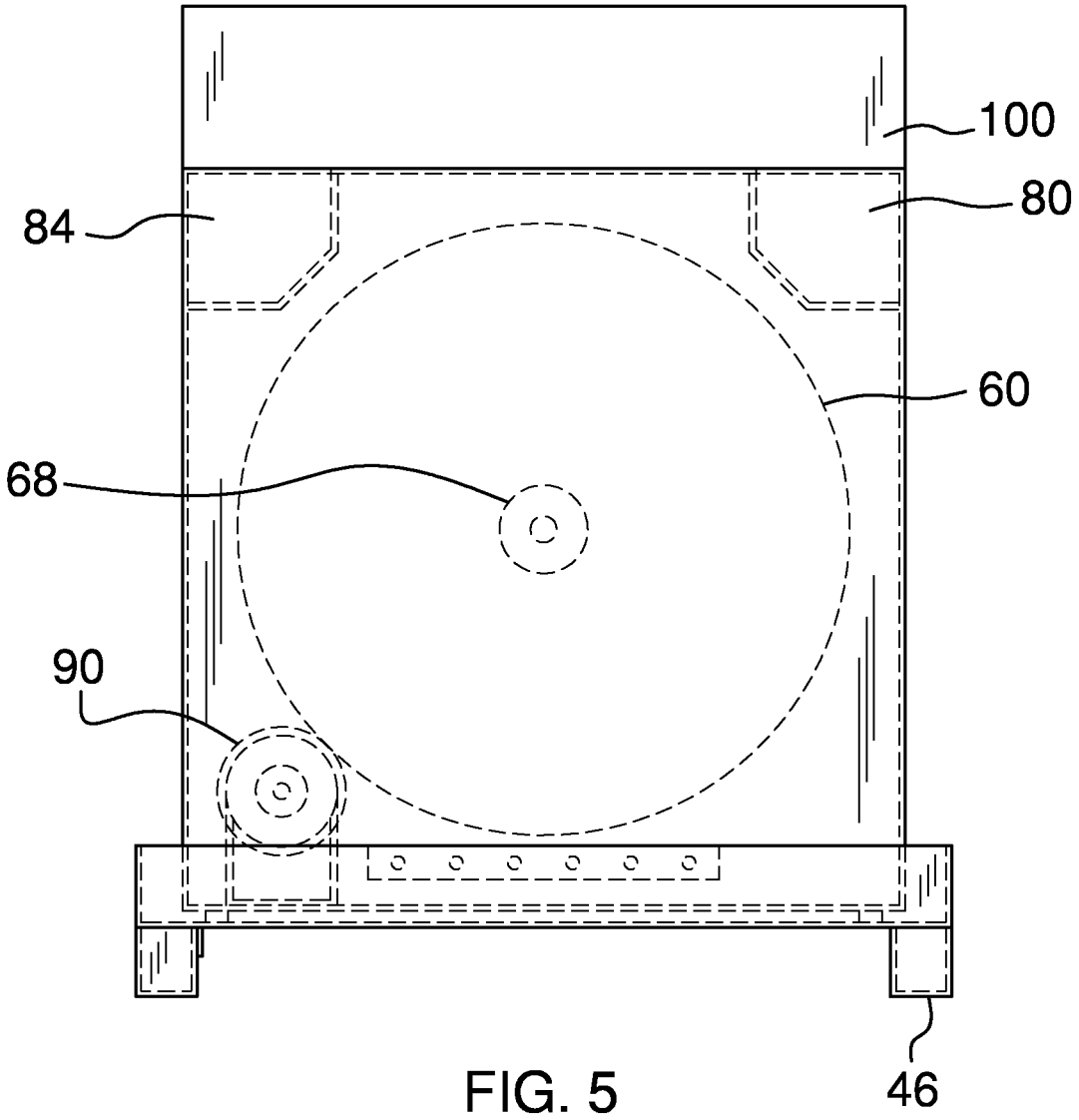
FIG. 5 is a rear detail view.

With reference now to the drawings, and in particular FIGS. 1 through 5 thereof, an example of the top access clothes dryer with motor-generator and catch pan employing the principles and concepts of the present top access clothes dryer with motor-generator and catch pan and generally designated by the reference number 10 will be described.

Referring to FIGS. 1 through 5, the top access clothes dryer with motor-generator and catch pan 10 has a case 20 having a front side 22 and a back side 24 spaced apart from the front side 22, a left side 26 and a right side 28 spaced apart from the left side 26, a top side 30 and a bottom side 32 spaced apart from the top side 30. A transparent panel 34 is disposed in the front side 22 adjacent the bottom side 32. A first door 40 and a second door 42 disposed selectively adjacent the first door 40 are disposed in the top side 30. Each door 40, 42 opens upwardly from an approximate center of the top side 30 with regard to the front side 22 and the back side 24. The first door 40 hingedly opens upwardly to a position above the left side 26. The second door 42 hingedly opens upwardly to a position above the right side 28.

A walled pan 44 having an upwardly facing opening 48 is selectively provided. The walled pan 44 is disposed beneath and selectively unfastened to the bottom side 32. A quartet of legs 46 is disposed below the bottom side 32. At least one of the legs 46 is hollow. A switched pump 50 is disposed within one hollow leg 46. An alarm 56 disposed in the walled pan 44 sounds upon an automatic initiation of the switched pump 50. The switched pump 50 is in an on condition only when sensing a water level within the hollow leg 46. Such switched pumps 50 are well known in the arts of water and other liquid evacuation. A filter 52 is disposed within the walled pan 44. The filter 52 is in operational communication with the switched pump 50. A drain line 54 is disposed below the walled pan 44. The drain line 54 is in operational communication with the switched pump 50. The walled pan 44 is selectively sized to hold the case 20 and an existing additional clothes handling appliance such as a washer, wherein an advantage against a water loss within an area or a room is enjoyed.

A constant diameter drum 60 is rotatably disposed within the case 20. The drum 60 has an in interior 62 and an exterior 64 spaced apart from the interior 62. The drum 60 rotates about a first bearing 66 disposed within the front side 22 and a second bearing 68 disposed within the back side 24. A hinged first drum door 70 having a first leading edge 72 and a second drum door 74 having a second leading edge 76 selectively disposed adjacent the first leading edge 72 are provided within the drum 60. The drum doors 70, 74 provide access from the exterior 64 to the interior 62. The first leading edge 72 and the second leading edge 76 selectively open outwardly from the drum 60 when in an open position. The first leading edge 72 and the second leading edge 76 selectively abut to seal the drum doors 70, 74 and the drum 60.

A pentagonal first storage compartment 80 having a first opening 82 is selectively sealed beneath the first door 40. The first opening 82 is continuously disposed from proximal the front side 22 to proximal the back side 24. The first storage compartment 80 is disposed adjacent the left side 26 and the top side 30. A pentagonal second storage compartment 84 having a second opening 86 is selectively sealed beneath the second door 42. The second opening 86 is continuously disposed from proximal the front side 22 to proximal the back side 24. The second storage compartment 84 is disposed adjacent the right side 28 and the top side 26.

A motor-generator 90 is disposed within the case 20 proximal the right side 28 and the bottom side 32. The motor-generator 90 has a centrally disposed axle 91 having a first end 92 and a second end 93 spaced apart from the first end 92. The motor-generator 90 has an electrical inlet 94 and an electrical outlet 95. The switched pump 50 is in electrical operational communication with the electrical inlet.

A drive wheel 96 is disposed on the first end 92. The drive wheel 96 is in frictional operational communication with the exterior 64. A blower wheel 97 is disposed on the second end 93. The blower wheel 97 is in operational communication with the interior 62, a practice extremely well known in the art of clothes dryers. The motor-generator 90 imparts a rotational kinetic energy to the drum 60 in a first condition of functioning as a motor. The motor-generator 90 absorbs and converts a rotational kinetic energy from the drum 60 in a second condition of functioning as a generator. Generated electricity from the motor-generator 90 is transferred to the electrical outlet 95 and thereupon employed by a user as chosen. Examples of a use of generated electricity might be to store the electricity in a battery or to convert and sell the electricity to an electrical power organization.

A control panel 100 is disposed on the top side 30 adjacent the back side 24. The control panel 100 includes a plurality of controls 102 in operational communication with the motor-generator 90. A vent 104 is disposed within the control panel 100. The vent 104 is in operational communication with the interior 62.

What is claimed is:

1. A top access clothes dryer comprising:

a case having a front side and a back side spaced apart from the front side, a left side and a right side spaced apart from the left side, a top side and a bottom side spaced apart from the top side;

a first door and a second door disposed selectively adjacent the first door, each door opening upwardly from an approximate center of the top side with regard to the front side and the back side; the first door hingedly opening upwardly to a position above the left side, the second door hingedly opening upwardly to a position above the right side;

a constant diameter drum rotatably disposed within the case, the drum rotating about a first bearing disposed within the front side and a second bearing disposed within the back side;

a motor and fan drive disposed within the case, the motor and fan drive in operational communication with the drum;

a hinged first drum door having a first leading edge and a hinged second drum door having a second leading edge selectively disposed adjacent the first leading edge;

wherein the first leading edge and the second leading edge selectively abut and seal the drum doors and the drum;

wherein the first leading edge and the second leading edge open outwardly from the drum when in an open position;

a pentagonal first storage compartment having a first opening selectively sealed beneath the first door, the first opening continuously disposed from proximal the front side to proximal the back side, the first storage compartment disposed adjacent the left side and the top side;

a pentagonal second storage compartment having a second opening selectively sealed beneath the second door, the second opening continuously disposed from proximal the front side to proximal the back side, the second storage compartment disposed adjacent the right side and the top side;

a control panel disposed on the top side adjacent the back side, the control panel in operational communication with the generator-motor; and a vent disposed within the control panel, the vent in operational communication with the interior.

2. A top access clothes dryer with motor-generator comprising:

a case having a front side and a back side spaced apart from the front side, a left side and a right side spaced apart from the left side, a top side and a bottom side spaced apart from the top side;

a transparent panel disposed in the front side adjacent the bottom side;

a first door and a second door disposed selectively adjacent the first door, each door opening upwardly from an approximate center of the top side with regard to the front side and the back side; the first door hingedly opening upwardly to a position above the left side, the second door hingedly opening upwardly to a position above the right side;

a constant diameter drum rotatably disposed within the case, the drum having a interior and an exterior spaced apart from the interior, the drum rotating about a first bearing disposed within the front side and a second bearing disposed within the back side;

a hinged first drum door having a first leading edge and a hinged second drum door having a second leading edge selectively disposed adjacent the first leading edge, wherein the first leading edge and the second leading edge selectively abut and seal the drum doors and the drum;

wherein the first leading edge and the second leading edge open outwardly from the drum when in an open position;

a pentagonal first storage compartment having a first opening selectively sealed beneath the first door, the first opening continuously disposed from proximal the front side to proximal the back side, the first storage compartment disposed adjacent the left side and the top side;

a pentagonal second storage compartment having a second opening selectively sealed beneath the second door, the second opening continuously disposed from proximal the front side to proximal the back side, the second storage compartment disposed adjacent the right side and the top side;

a motor-generator disposed within the case proximal the right side and the bottom side, the motor-generator having a centrally disposed axle having a first end and a second end spaced apart from the first end, the motor-generator having an electrical inlet and an electrical outlet;

a drive wheel disposed on the first end, the drive wheel in frictional operational communication with the exterior;

a blower wheel disposed on the second end, the blower wheel in operational communication with the interior;

wherein the motor-generator imparts a rotational kinetic energy to the drum in a first condition of functioning as a motor; and wherein the motor-generator absorbs and converts a rotational kinetic energy from the drum in a second condition of functioning as a generator;

a control panel disposed on the top side adjacent the back side, the control panel in operational communication with the generator-motor; and a vent disposed within the control panel, the vent in operational communication with the interior.

3. A top access clothes dryer with motor-generator and catch pan comprising:

a case having a front side and a back side spaced apart from the front side, a left side and a right side spaced apart from the left side, a top side and a bottom side spaced apart from the top side;

a transparent panel disposed in the front side adjacent the bottom side;

a first door and a second door disposed selectively adjacent the first door, each door opening upwardly from an approximate center of the top side with regard to the front side and the back side; the first door hingedly opening upwardly to a position above the left side, the second door hingedly opening upwardly to a position above the right side;

a walled pan having an upwardly facing opening selectively disposed beneath the bottom;

a quartet of legs disposed below the bottom side, at least one of the legs being hollow;

a switched pump disposed within one hollow leg;

a filter disposed within the walled pan, the filter in operational communication with the switched pump;

a drain line disposed below the walled pan, the drain line in operational communication with the switched pump;

an alarm disposed within the walled pan;

wherein the switched pump is configured to drain the walled pan with a liquid sensed within the hollow leg by the switched pump;

wherein the alarm sounds upon an automatic initiation of the switched pump, a constant diameter drum rotatably disposed within the case, the drum having an in interior and an exterior spaced apart from the interior, the drum rotating about a first bearing disposed within the front side and a second bearing disposed within the back side;

a hinged first drum door having a first leading edge and a hinged second drum door having a second leading edge selectively disposed adjacent the first leading edge, wherein the first leading edge and the second leading edge selectively abut and seal the drum doors and the drum;

wherein the first leading edge and the second leading edge open outwardly from the drum when in an open position;

a pentagonal first storage compartment having a first opening selectively sealed beneath the first door, the first opening continuously disposed from proximal the front side to proximal the back side, the first storage compartment disposed adjacent the left side and the top side;

a pentagonal second storage compartment having a second opening selectively sealed beneath the second door, the second opening continuously disposed from proximal the front side to proximal the back side, the second storage compartment disposed adjacent the right side and the top side;

a motor-generator disposed within the case proximal the right side and the bottom side, the motor-generator having a centrally disposed axle having a first end and a second end spaced apart from the first end, the motor-generator having an electrical inlet and an electrical outlet, the switched pump in electrical operational communication with the electrical inlet and the electrical outlet;

a drive wheel disposed on the first end, the drive wheel in frictional operational communication with the exterior;

a blower wheel disposed on the second end, the blower wheel in operational communication with the interior;

wherein the motor-generator imparts a rotational kinetic energy to the drum in a first condition of functioning as a motor; and wherein the motor-generator absorbs and converts a rotational kinetic energy from the drum in a second condition of functioning as an alternator;

a control panel disposed on the top side adjacent the back side, the control panel in operational communication with the generator-motor; and a vent disposed within the control panel, the vent in operational communication with the interior.

4. The top access clothes dryer with motor-generator and catch pan of claim 3 wherein the pan is of a size sufficient to hold the case and an additional clothes handling appliance.

* * * * *